US007156258B2

(12) United States Patent
Eckert

(10) Patent No.: US 7,156,258 B2
(45) Date of Patent: Jan. 2, 2007

(54) COUNTER FOR COUNTING METERED DOSES OF LIQUID, PASTRY OR SOLID PRODUCTS AND DEVICE FOR THE METERED DISPENSING OF SUCH PRODUCTS

(75) Inventor: Thomas Eckert, Mellrichstadt (DE)

(73) Assignee: Boehringer Ingelheim microparts GmbH, Dortmund (DE)

( * ) Notice: Subject to any disclaimer, the term of this patent is extended or adjusted under 35 U.S.C. 154(b) by 404 days.

(21) Appl. No.: 10/493,067

(22) PCT Filed: Jun. 12, 2002

(86) PCT No.: PCT/EP02/06458

§ 371 (c)(1),
(2), (4) Date: Apr. 30, 2004

(87) PCT Pub. No.: WO03/107269

PCT Pub. Date: Dec. 24, 2003

(65) Prior Publication Data

US 2005/0017020 A1 Jan. 27, 2005

(51) Int. Cl.
*B67D 5/06* (2006.01)

(52) U.S. Cl. ..... 222/23; 222/30; 222/32; 222/36; 222/38; 128/200.23; 128/205.23

(58) Field of Classification Search ..... 222/23, 222/27–33, 36–38, 402.1, 402.13, 402.23, 222/402.22, 402.25; 128/205.23, 200.23, 128/203.23, 203.12
See application file for complete search history.

(56) References Cited

U.S. PATENT DOCUMENTS 2,875,950 A 3/1959 Mast et al.
5,243,970 A * 9/1993 Ambrosio et al. ..... 128/203.15
5,349,945 A * 9/1994 Wass et al. ..... 128/200.23
5,740,792 A * 4/1998 Ashley et al. ..... 128/203.15
6,164,494 A * 12/2000 Marelli ..... 222/38
6,234,168 B1 * 5/2001 Bruna ..... 128/203.12
6,283,365 B1 * 9/2001 Bason ..... 235/116
6,761,161 B1 * 7/2004 Scarrott et al. ..... 128/200.14
6,907,876 B1 * 6/2005 Clark et al. ..... 128/200.23
6,938,796 B1 * 9/2005 Blacker et al. ..... 222/23

FOREIGN PATENT DOCUMENTS

| | | |
|---|---|---|
| DE | 100 61 723 | 7/2002 |
| EP | 472 985 | 3/1992 |
| EP | 949 584 | 10/1999 |
| WO | 98/01822 | 1/1998 |

* cited by examiner

*Primary Examiner*—Frederick C. Nicolas
(74) *Attorney, Agent, or Firm*—Oblon, Spivak, McClelland, Maier & Neustadt, P.C.

(57) ABSTRACT

A counter including at least one counting ring, a switch, and an actuator movable in its longitudinal axis direction. The switch includes a guide and a switching element movable in an axial and azimuthal direction relative to the guide. The guide has at least one curved surface, directing at least one projecting part disposed on the switching element. A switching cam on the switching element meshes with toothing of the counting ring. The switching device converts linear movement of the actuator into rotational movement of the counting ring. The counting ring, secured by ratchets, rotates one angular increment each actuation of the actuator. The counter is suitable for different storage containers dispensing a product portion by portion and can be configured as a daily quantity counter or a total quantity counter, for example. The counter components are inserted into each other and held together by catch elements.

32 Claims, 7 Drawing Sheets

Figures 1, 2:
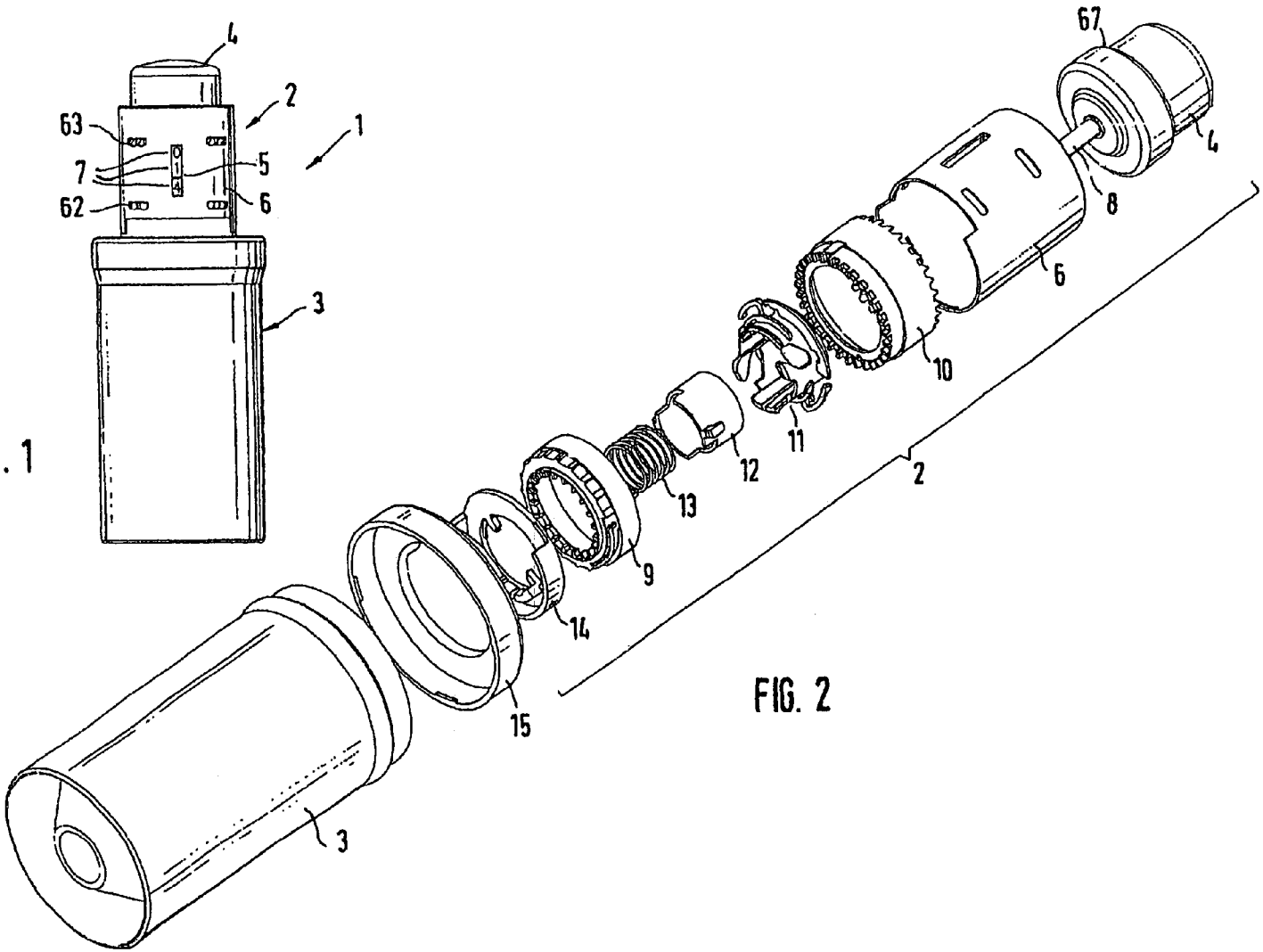

COUNTER FOR COUNTING METERED DOSES OF LIQUID, PASTRY OR SOLID PRODUCTS AND DEVICE FOR THE METERED DISPENSING OF SUCH PRODUCTS

The invention relates to a counter for counting metered doses of liquid, pasty or solid products, such as medicaments or the like, from a storage container. The counter comprises at least one counting ring, a switching device and an actuating means which can be moved essentially lineally in the direction of the longitudinal axis of the counter.

The invention aims to adapt a counter of this type to specific requirements in respect of function and reliability.

Counters of this type are used, for example, in devices from which tablets or small quantities of a liquid, for example as drops or as a spray, are to be dispensed portion by portion from a storage container. In the case of a tablet dispenser, counters of this type serve, for example, to reliably record the particular quantity of tablets to be taken by a user per day. For this purpose, each actuation of the mechanism of the dispensing device, which leads to a tablet or a liquid dose being dispensed, is counted and indicated on a daily basis by means of one or two counting rings. The user can thus precisely identify how many tablets or liquid doses he has already taken on a day and whether he still has more to take.

Furthermore, counters of this type can furthermore also be used for indicating the total quantity of dispensed tablets, liquid doses, drops or the like, so that it can be identified how many portions have already been taken from an existing total quantity. Correspondingly, on the other hand, the counter can also be used for indicating the portions which can still be taken out of the storage container.

The same recording possibilities are provided in the case of an aerosol dispenser. In this case too, depending on the design of the counter, the number of portions taken on a day or the number of portions taken in total or the number of portions which can still be taken out of the storage container can be indicated.

In addition to the counting of portions of a medicament which have been taken, a counter of this type may also serve to count the portions of any other desired liquid, pasty or solid products dispensed from a storage container.

Known counters are constructed in an extremely complicated manner from a multiplicity of individual elements. Thus, by way of example, counters are known which, for moving a counting ring by an angular increment during an individual actuation, comprising toggle lever mechanism comprising a multiplicity of parts of complex shape and interacting with one another. In addition, counters are known which comprise a plurality of interacting disk units and various means for transmitting the rotational movement from one disk unit to the other. Each of the known counters is of quite complex construction, which means that there is a risk of malfunctions. However, a malfunction of the counter may result in serious consequences, particularly if the counter serves to count portions of a medicament which have been taken.

A counter of the generic type is disclosed in DE 298 14 647 U1. For indexing a counting ring to the next position, a switching finger is provided which is designed as a movably mounted toggle lever, and which engages in a toothing on the counting ring for indexing it to the next position. The construction is complicated and susceptible to errors.

Furthermore, GB 1 317 315 is to be mentioned as prior art, in which a counter having only a counting ring which is arranged coaxially is described, said counter being assigned an actuating means which can be moved essentially lineally and in the direction of the longitudinal axis of the counter. A switching element which interacts with a guide element is provided for the switching. Angle levers are articulated pivotably on the circumference of the guide element and, when the actuating means is actuated, are pressed and pivoted about the axis, as a result of which the switching element is moved by an angular increment.

DE 33 02 160 A1 specifies a metering device which can be actuated and has a counting device which comprises a counting ring which is mounted on a base part and is indexed by one step per actuating stroke by means of an indexing device having interacting, correspondingly beveled ribs.

The invention is based on the object of specifying a counter having a functionally reliable switching and counting mechanism which is unavoidably actuated and indexed when a portion is taken from the total quantity contained in a storage container.

This object is achieved according to the invention by a counter for counting metered doses of liquid, pasty or solid products from a storage container, the counter comprising at least one counting ring which is arranged coaxially with the longitudinal axis of the counter and is mounted rotatably, and being provided with a switching device for rotating the counting ring when an actuating means which can be moved essentially lineally and in the direction of the longitudinal axis of the counter is actuated. When the actuating means is actuated, a dose of the product is dispensed from the storage container.

The counter is characterized by the following features:

the switching device comprises a guide element and a switching element which are both arranged coaxially with the longitudinal axis, it being possible for the switching element to be moved axially and azimuthally with respect to the guide element.

The switching element has a projection which, when the actuating means is actuated, is guided in such a manner along a curved surface provided on the guide element that a switching cam provided on the switching element is brought into engagement with a cam retainer provided on the at least one counting ring and then a rotational movement is initiated causing the at least one counting ring to be rotated by an angular increment.

In a further embodiment, the counter comprises a first and a second counting ring. The two counting rings are arranged coaxially with the longitudinal axis of the counter; they are mounted rotatably relative to each other and can be coupled to each other. This counter is provided with a coupling device with which the first counting ring is coupled to the second counting ring for moving the two counting rings together.

In the case of this mechanism, at least one curved surface is provided on the fixed guide element as a guide surface for a projection which is provided on the switching element and slides along the curved surface. If a dispensing device which includes the counter according to the invention is actuated via an actuating means, then in this case the switching element is moved coaxially, with the projection bearing against the guide surface. The guide surface is directed in such a manner that, firstly, a switching cam provided on the switching element engages in a cam retaining provided on the first counting ring. Secondly, when there is a further movement of the actuating means and therefore of the switching element, a rotational movement is initiated by means of the curved shape which has been selected. The rotational movement of the switching element causes—on account of the engagement of the cam—the first counting ring to be rotated by an angular increment, which depends on the length of the movement travel of the actuating means and therefore on the stroke of the switching means. An unavoidably running mechanism is therefore realized, the mechanism being compelled to record the actuation of the mechanism for dispensing a dose of the product from the storage container.

The curved surface is preferably provided on the end edge of a recess in the wall of the essentially annular guide element, the projection engaging in the recess. The effect which can be achieved by the invention by means of the shape of the curved surface is a movement of the switching element, which is an axial movement at the beginning, then is a combined axial and azimuthal movement and is preferably an axial movement at the end of the stroke movement. This has the advantage that the rotational movement, with which the actuation of the actuating means is recorded, begins only after an axial movement and therefore after the actuating means has been pressed into a sufficient extent. Therefore, not every slight actuation of the actuating means resulting from inattentiveness for example is counted. By appropriately varying the curved shape, any desired sequence of movement can be realized. The initiation of the rotation can be changed virtually as desired by means of an appropriate increase in the curved surface. For example, at the beginning of the rotational movement initiated, a relatively small rotation relative to the stroke of the switching element can be achieved, and only later can the pronounced rotational movement start up, by means of a correspondingly changed curved shape, this rotational movement leading to the stroke of the switching element being counted.

According to the invention, the guide element can be essentially annular and the switching element can be essentially hollow cylindrical. The switching element can be arranged in the interior of the guide element. For safety reasons and for further improvement of the functionally reliable system, it has proven expedient if there are preferably two mutually opposite projections on the switching element and two preferably mutually opposite curved surfaces on the guide element. In this configuration, the switching element is guided at two points making tilting if the switching element is subjected to a load due to pressure more difficult. The tilting of the switching element is also prevented with just one projection and one curved surface if the switching element is guided in the interior of the annular guide element.

It is particularly advantageous if the switching element can be moved counter to a restoring force. The switching element is returned back into its starting position by the restoring force as soon as the pressure caused by the actuation of the actuating means disappears. The restoring force can preferably be produced by a spring. As a result, the switching element is pushed back after the actuating pressure disappears. In such a case, it is expedient if there is a further curved surface against which the switching element is pressed by the (particular) projection and is guided along this curved surface back into the starting position again. In this case, there is a second positive guide using a curved surface.

It is particularly effective if the spring producing the restoring force is a helical spring which is mounted with its one end on a base plate and with its other end on the switching element. The helical spring is then twisted and compressed during the rotation and displacement of the switching element forced by the curved surface. The switching element is pushed back with simultaneous rotation back into the starting position as soon as the pressure on the actuating means has disappeared and the switching cam no longer engages in the cam retainer.

The switching cam is expediently integrally formed in an extension of the projection. The toothing of the first counting ring interacts with the switching cam. The toothing of the first counting ring has an oblique surface on the side facing the switching cam. If the switching element is moved axially when the actuating means is actuated, and the switching cam enters into the toothing, the switching cam first of all strikes against the oblique surface. On further axial movement of the switching cam, the first rotational movement is initiated. This rotational movement is then continued in accordance with the shape of the curved surface.

The switching element is reliably guided in the annular and likewise hollow cylindrical guide element. For this purpose, a plurality of guide sections are preferably provided, against which the switching element bears and along which it slides. So that, particularly in the case of the counter being used together with an aerosol container, the air is reliably replenished, it is expedient if there is at least one region in which the switching element is at a distance from the guide element. This enables an air duct to be realized.

A counting ring can rotate back under deliberate manipulation or inadvertently, which falsifies the counting result. In order to prevent an error of this type, at least two detent pawls can be provided according to the invention on the guide element. Each detent pawl interacts with the toothing of the first and of the second counting ring in such a manner that the counting ring is blocked from rotating in the direction opposed to the counting direction. The detent pawls, which are designed as spring arms, have corresponding oblique surfaces, on which a tooth flank of the toothing engages and, during a rotation of the tooth, lifts up the detent pawl which then latches behind the toothing. In this case, it is expedient if there are in each case two detent pawls which are offset with respect to each other and engage in the toothing at different angles of rotation during the rotation of the particular counting ring. These detent pawls, which can be called the primary and secondary detent pawls, make it possible to record a dispensing of a product which has already taken place, if the actuating means has not been entirely pushed through. In this case, the first detent pawl already engages when the rotation for example of merely up to 90% of the total rotation has taken place. At a rotation of, for example, 90% of the entire rotation, the portion can already be dispensed even if the entire stroke of the switching element has not yet been completed. If the actuating means is now relieved of load, then, firstly, the counting is registered and, secondly, the counting ring is blocked by the detent pawl engaging earlier. When the actuating means is completely pushed through, the two detent pawls engage. This prevents a manipulation of the counter, since both detent pawls have to be disengaged in order to rotate back a counting ring by manipulating it, this being virtually impossible if the counter and therefore the detent pawls are encapsulated in a housing.

According to a development of the invention, guide surfaces for the first and the second counting ring, and at least two latching elements are provided on the guide element. One of these latching elements engages behind a latching section of the second counting ring. The other latching element engages behind a latching section of the base plate, which guides the first counting ring on the side lying opposite the guide element. The counting rings, the guide element, the switching element, the spring element and the base plate therefore form a manageable unit. The core piece of the counter comprises just these six elements. They are all held together by means of two latching elements which latch onto corresponding latching sections of the parts on the end side, namely of the second counting ring and the base plate. All six elements of the counter form in practice a non-releasable, manageable unit. This unit can be inserted, for example, into an angled component which is placed onto an aerosol container.

According to the invention, the coupling device can comprise at least one first projection present on a base plate and a latching pawl which is present on the first counting ring and has a second projection. The first projection interacts with the second projection in an appropriate rotational position of the first counting ring, in which case the latching pawl is lifted up and engages in a toothing provided on the second counting ring. Appropriate positioning of the first projection on the base plate enables the first counting ring to be coupled to the second counting ring after any number of actuations and enables the second counting ring to be rotated further by an angular increment. In the case, for example, of a daily quantity counter, the projection can be arranged on the base plate in such a manner that a total of three individual doses per day are to be taken from the storage container, and, when the third dose is taken, the counting rings are coupled and rotated together. In this case, the first counting ring indicates the number of particular individual doses, and the second counting ring specifies, for example, the day of the week or the day of the month. A second counting ring is then set to the next day and the first counting ring again shows, for example, a "1", that the user knows that he has not yet taken a dose on the following day, but has taken all of the prescribed doses for the present day. By means of an appropriate number of teeth on the second counting ring and appropriate positioning of the projections (optionally a plurality of projections) on the base plate, it is possible to set any desired number of daily doses and therefore coupling times.

Furthermore, there can be a stop on the guide element, against which a projection provided on the second counting ring strikes as soon as the second counting ring has reached its end position. In the case of a residual quantity counter, the stop bearing against the projection prevents the second counting ring, on which, for example, the numbers 31, 29, 28, . . . 3, 2, 1 are provided, from rotating further despite the actuating means being actuated, if the last dose has been taken. If a blocking means has not been provided here, the second counting ring is rotated further from 1 to the number 31 again, which irritates the user. In order to prevent the same thing from also happening in the case of the first counting ring, there can be a covering section on the second counting ring for covering some regions of the first counting ring, said covering section, when the second counting ring moves into its end position, being rotated into a viewing position. This covering section is then rotated into a viewing window when the last dose has been taken, and the two counting rings display "000". On account of the blocking, the second counting ring cannot be rotated further unlike the first counting ring, which springs again to "9" on further actuation. So that this "9" is not visible, the first counting ring is covered in some regions by means of the covering section. On further actuation of the device, the covering section remains immovably in the viewing window. The remaining quantity can be taken out of the storage container without a counting display being visible.

The counting rings, the guide element and the switching element can be accommodated in an essentially hollow cylindrical housing which has at least one window section through which the markings provided on the outer surface of the counting rings can be seen. The counting rings preferably consist of plastic and can be marked by a laser inscription. For better identifiability of the markings, an optical enlargement element in the form of a magnifying glass can be arranged in the window section. The housing preferably consists of plastic. If a transparent plastic is used, the optical enlargement element can be integrally formed on the housing.

In the case of a daily quantity counter, for example, the number of particular daily doses can be indicated by means of the first counting ring and the particular day of the week or day of the month can be indicated by means of the second counting ring. In order to be able to set the counting rings to the desired starting position, the housing can have apertures which can be used for engagement in a respective toothing on the first or on the second counting ring for setting purposes. The user can set the counting rings appropriately using a small tool or the like. In this case, each counting ring can be assigned in each case two apertures which are arranged at a distance from each other on the circumference of the housing and permit handling by right-handed people and by left-handed people.

In order to connect the housing permanently to its "internals", latching elements for engaging behind a latching section on the base plate can be provided on at least one end side of the housing. On the opposite end side of the housing there can be a shoulder which provides the end support for the actuating means. The switching element bears directly against the actuating means, which can be displaced axially during actuation, and is coupled in its movement directly to the actuating means.

The actuating means may be a push button which is permanently coupled as part of the counter. In the case of a dispenser for tablets or the like, for example, an actuating tappet is provided on the push button on its side which faces the counter. The actuating tappet interacts through the counter with a mechanism which is integrated in the storage container and is intended for dispensing tablets. The storage container can either be connected permanently to the counter, or the storage container can be connected releasably to the counter.

In the case of a dispenser for tablets or the like, a lid covering the storage container can be integrally formed on or fastened to the base plate. In the case of a dispenser for an aerosol, a spray nozzle can be integrally formed on or fastened to the base plate.

It has proven expedient to provide a securing mechanism which prevents an unintentional or unauthorized actuation of the device. This securing mechanism, which, for example for actuating the actuating means, first of all requires the actuating means to be rotated, serves in particular as a childproof lock.

In addition to the counter according to the invention, the invention relates to a device for the metered dispensing of liquid, pasty or solid products, in particular of medicaments. This device comprises a storage container containing the product which is to be dispensed, and a counter according to the invention of the type described at the beginning.

The counter may be placed releasably onto the storage container, and the storage container can be replaced or refilled. This is expedient in particular in the case of tablet dispensers and in the case of other devices for the metered dispensing of liquid or pasty products. In the case of an aerosol dispenser, a counter according to the invention which is placed on releasably can be reused a number of times.

Finally, according to a development of the invention, a counter according to the invention can be releasably or non-releasably integrated into an—optionally angled—mouthpiece. A storage container, for example an aerosol flask, can be releasably inserted into the mouthpiece. A spray nozzle, for example, can be fixedly integrated into the mouthpiece, and the counter together with the aerosol flask can be releasably inserted into the mouthpiece. The mouthpiece can be reused, and the aerosol flask can be replaced after it has been emptied. The counter itself can likewise be reused, if appropriate.

The counter according to the invention has the following advantages:

- It has a functionally reliable mechanism for guiding the switching element. The counter is functionally reliable as a whole on account of the positive guidance by means of the curved surface.
- Virtually any desired sequence of movement of the switching element can be achieved by varying the shape of the curved surface on the guide element.
- The securing of each counting ring by means of two detent pawls and the encapsulation of the counter in a housing make it possible to prevent a counting ring from rotating back and therefore the counter from being manipulated.
- Owing to the small number of its elements, the entire counter can be produced inexpensively and can be fitted in a simple manner.
- It can be kept very small.
- It can be used in virtually all commercially available appliances for the dispensing of metered portions from a storage container without substantial change.
- It can be used in all dispensers in which the number of metered portions which are dispensed within a predetermined period of time is to be indicated reliably.
- The use of the counter is not restricted to dispensers from which metered portions of a medicament are dispensed.
- The customary storage containers from which metered portions are dispensed do not need to be changed for interaction with the counter.

Figure 3:
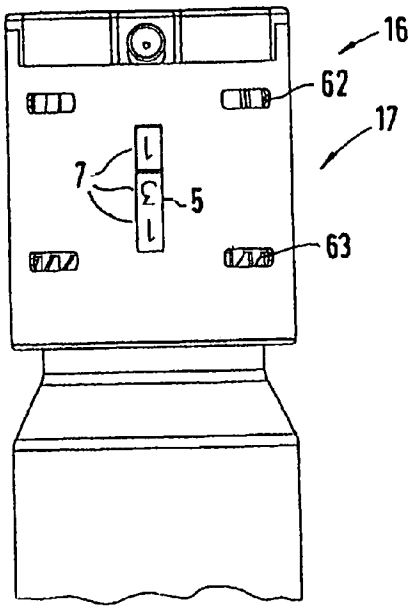
Figure 4:
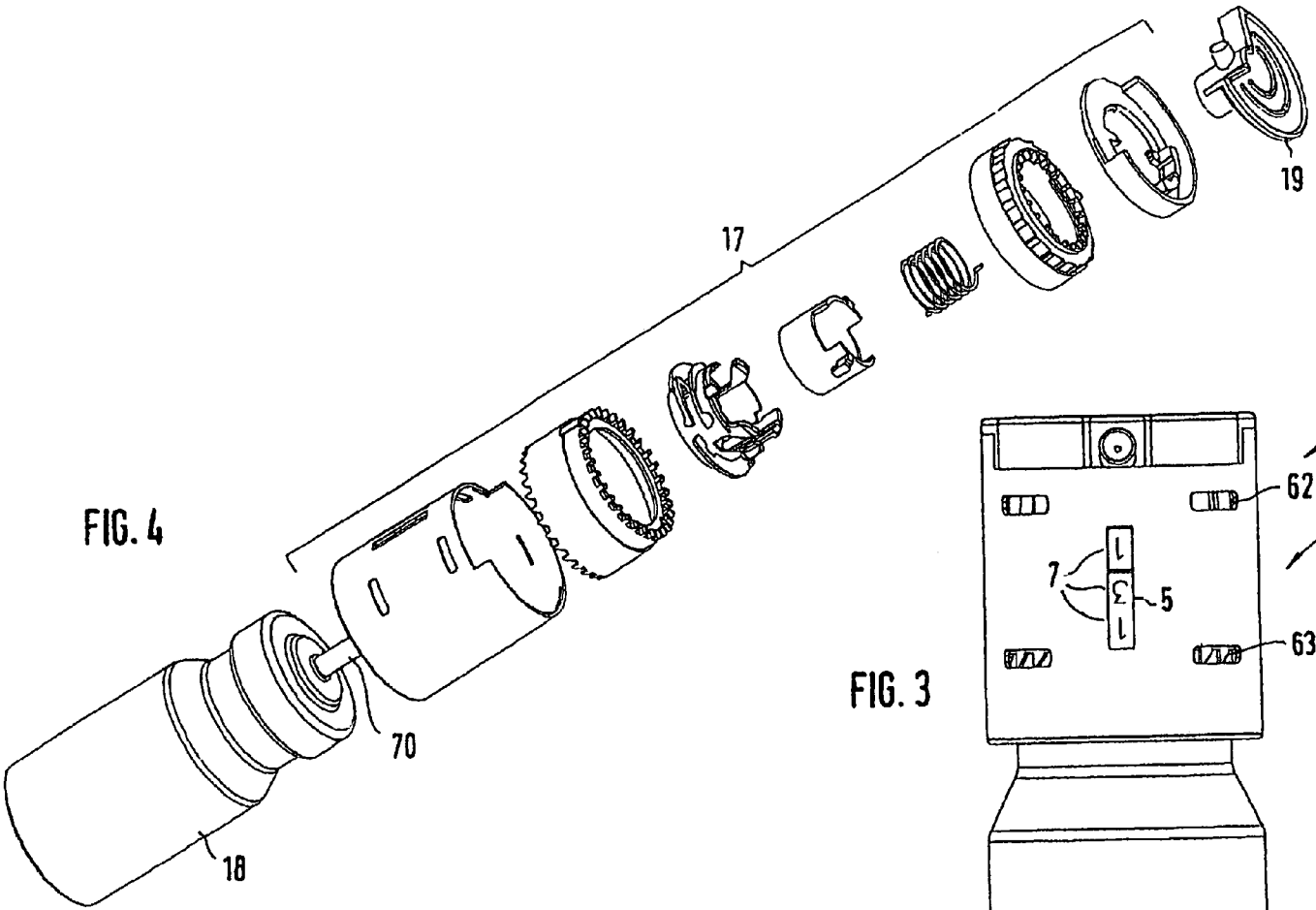
Figure 5:
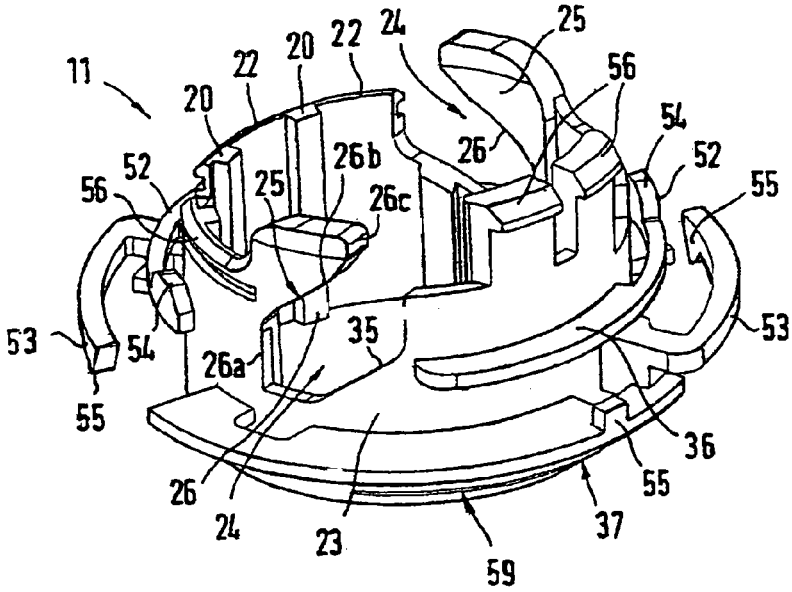
Figure 6:
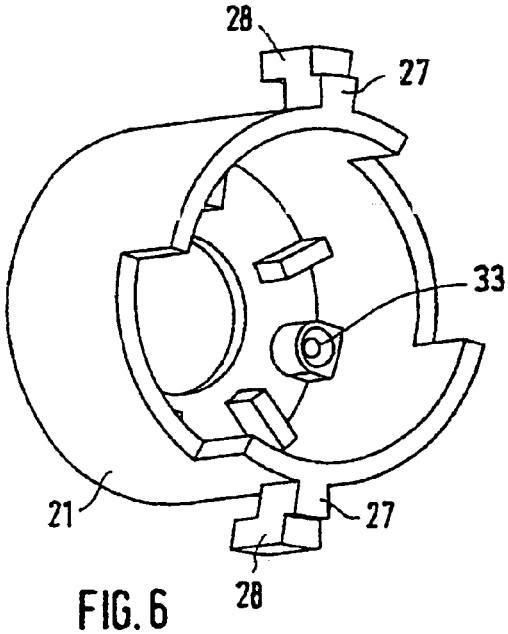
Figure 7:
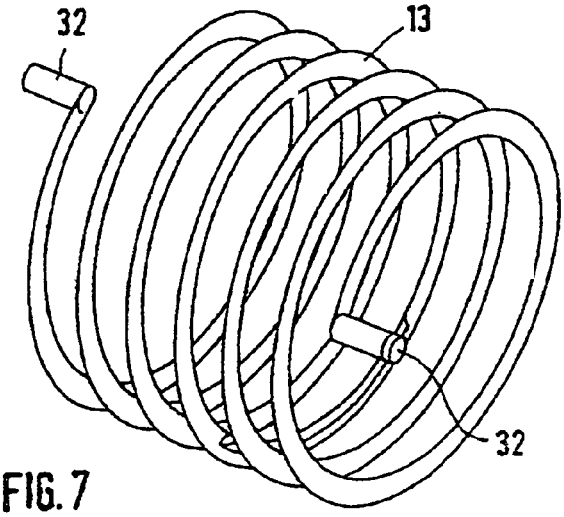
Figure 8:
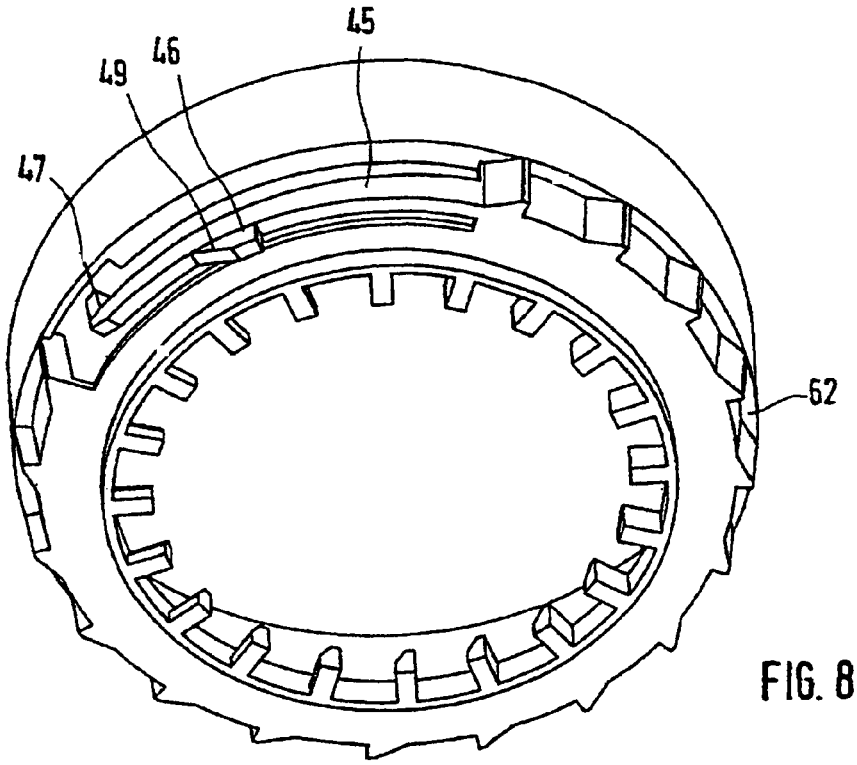
Figure 9:
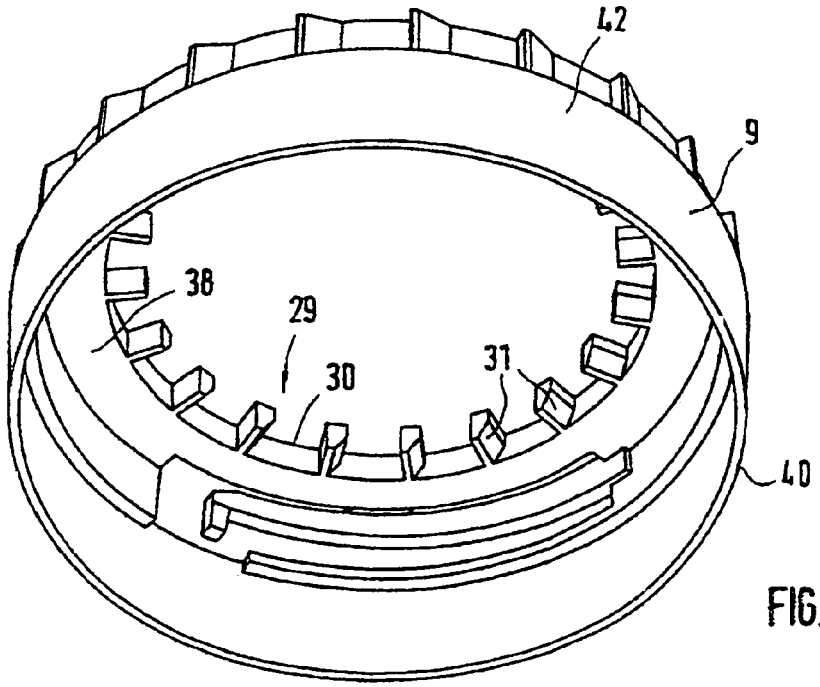
Figure 10:
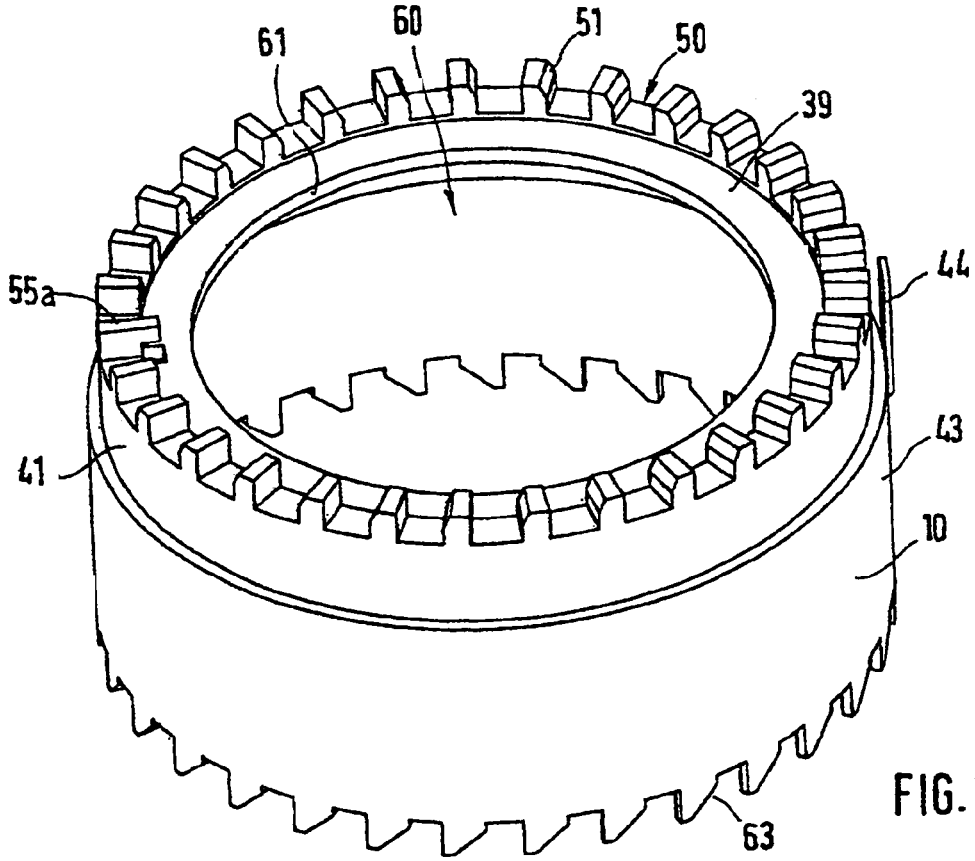
Figure 11:
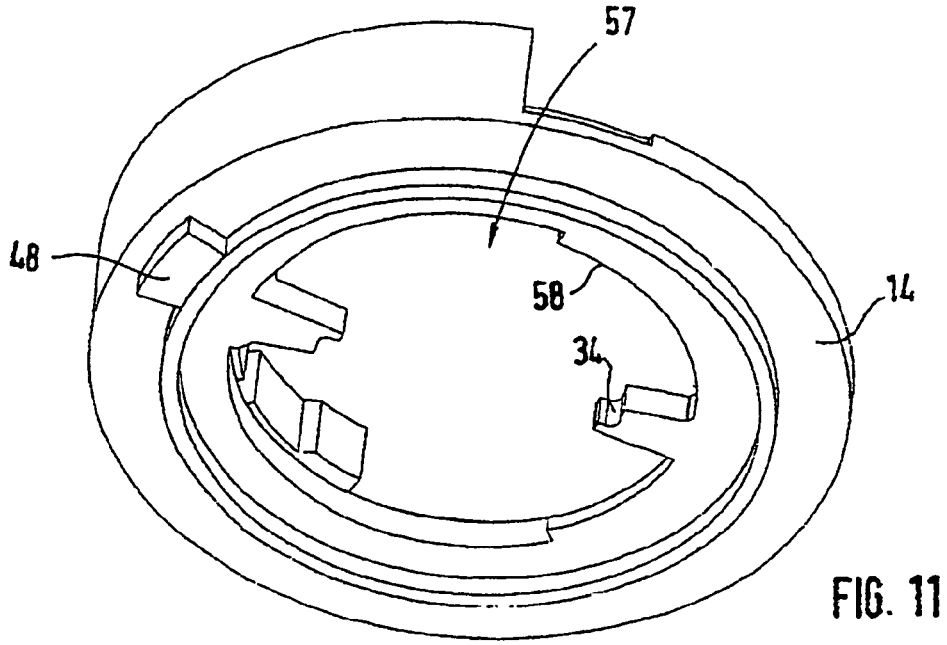
Figure 12:
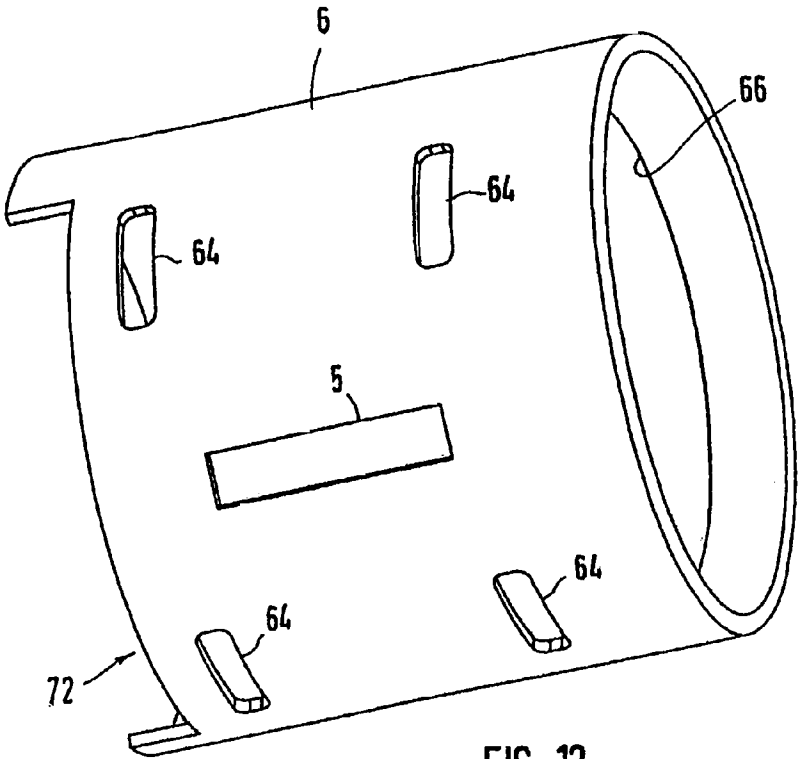
Figure 13:
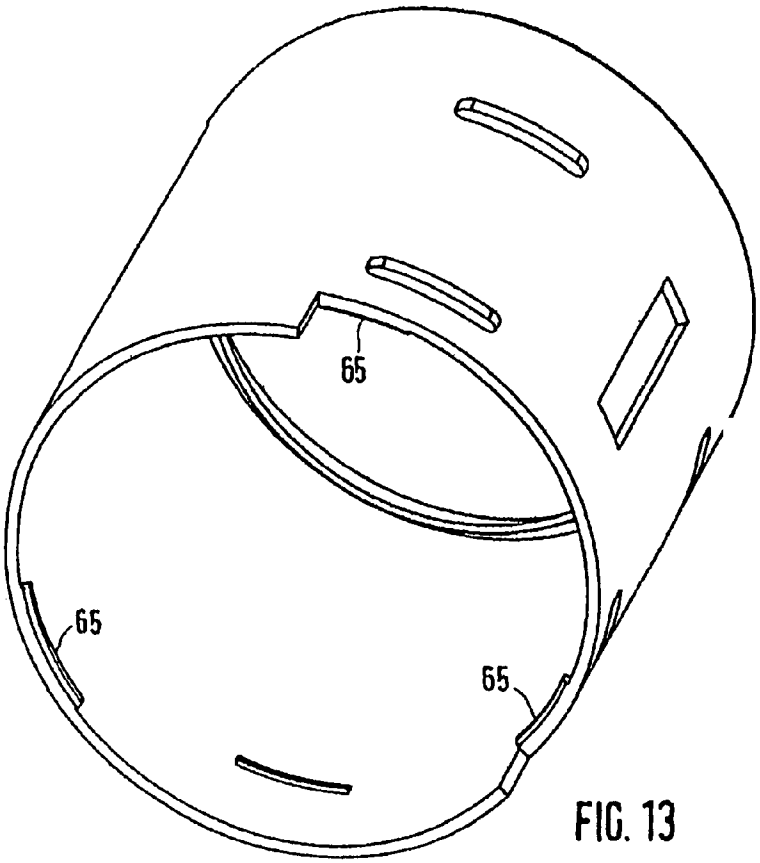
Figure 14:
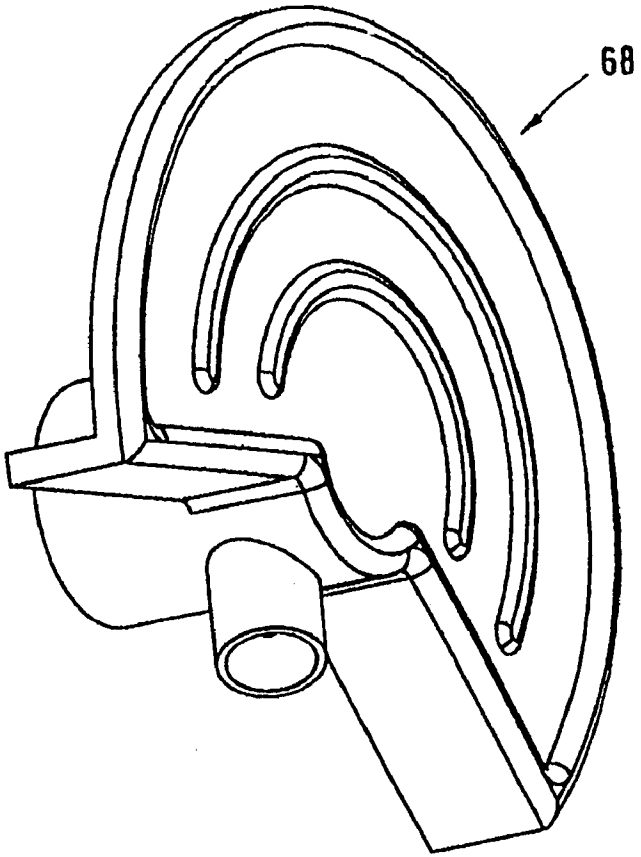
Figure 15:
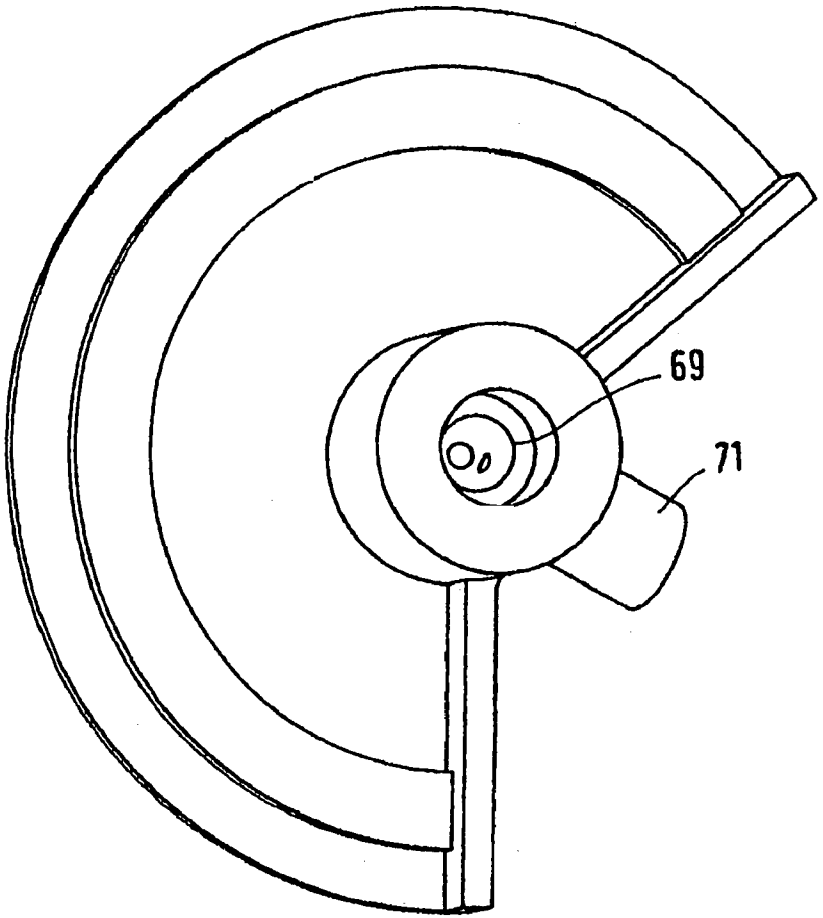

Further features and details of the invention emerge from the following exemplary embodiments and with reference to the drawings, in which:

FIG. 1 shows a view of a dispensing device having a counter according to the invention in a first embodiment, FIG. 2 shows an exploded illustration of the dispensing device from FIG. 1, FIG. 3 shows a view of a dispensing device having a counter according to the invention in a second embodiment, FIG. 4 shows an exploded illustration of the dispensing device from FIG. 3, FIG. 5 shows a perspective view of a guide element, FIG. 6 shows a perspective view of a switching element, FIG. 7 shows a perspective view of a spring, FIGS. 8 & 9 show perspective views of the upper and lower sides of the first counting ring, FIG. 10 shows a perspective of the second counting ring, FIG. 11 shows a perspective view of the base plate, FIGS. 12 & 13 show two perspective views of the housing, and FIGS. 14 & 15 show perspective views of a spray nozzle.

FIG. 1 shows a device (1) according to the invention for the metered dispensing of a product, for example of one individual tablet in each case. The device comprises a counter (2) according to the invention which is placed on a storage container (3). The storage container (3) is connected immovably to the base plate (14) of the counter (2). When the device according to FIG. 2 is used, an actuating means in the form of a push button (4) has to be pushed into the housing of the counter, as a result of which a mechanism situated in the storage container is actuated and is used to dispense a tablet from the storage container (3). This dispensing of the tablet is recorded by means of the counter and indicated in a window opening (5) in the housing (6) of the counter by means of the numbers (7) visible in the window. In this exemplary embodiment, a daily quantity counter shows the number of tablets dispensed on a day from the storage container. The number "01" indicates the day of the current month, in this case the first of the month, and the number "4" indicates that on this day the fourth tablet has been taken.

FIG. 2 shows an exploded illustration of all of the elements of the device (1) from FIG. 1. The device (1) comprises an actuating means in the form of a push button (4), on the end side of which an actuating tappet (8) is provided, said actuating tappet interacting with a mechanism for dispensing tablets that is integrated in the storage container (3). The push button (4) is integrated in the housing (6) and held captively there.

The counter (2) comprises a first counting ring (9) and a second counting ring (10) which indicate the information about the portions dispensed from the storage container. The daily quantity counter indicates on the first counting ring (9) the number of portions taken on a day, and the second counting ring (10) indicates the particular day of the month. The two counting rings (9) and (10) are manufactured from plastic and labeled on their outer sides with the appropriate sequences of numbers. The second counting ring (10) bears the sequences of numbers "01, 02, 03, . . . , 29, 30, 31", the first counting ring (9) bears, depending in each case on the product specification, the numbers "0, 1, 2, . . . x" depending on which daily dose the user has been prescribed. For example, it is possible for "x" to be "12".

On each actuation of the push button (4), the actuating being used to dispense a tablet, the first counting ring (9) is moved further by an angular increment, in which case the number following next can be seen in the window (5). With the removal of the last daily dose, the two counting rings (9) and (10) are coupled to each other via a coupling mechanism and further rotated together by an angular increment. In this example, the first counting ring indicates "0" and the second counting ring indicates "02", i.e. the second day of the month, on which a tablet has not yet been taken.

The counter comprises a guide element (11) which is of annular and hollow-cylindrical design, and in which a switching element (12) is arranged in an axially displaceable and azimuthally rotatable manner. A spring (13), here a helical spring, is mounted with its one end on the switching element (12) and with its other end on a base plate (14). This spring produces a restoring force against which the switching element is moved.

The first counting ring (9) is rotated via this switching element, which lies with its end edge (on the right in FIG. 2) directly on the opposite bottom surface of the push button (4). When the push button is actuated, the switching element (12) is displaced axially in the fixed guide element (11) until switching cams present on the switching element (12) engage in a cam retainer in the form of a toothing of the first counting ring (9). As a result, a rotational movement of the switching element is initiated, and the first counting ring (9) is rotated by an angular increment. During the movement of the switching element (12) the spring (13) is tensioned; after release of the push-button pressure, the spring (13) is relaxed and guides the switching element (12) back into the starting position again.

A lid (15) for covering the storage container (3) is fastened to the base plate (4). If appropriate, the base plate may be integral with the lid (15).

FIG. 3 shows another embodiment according to the invention of a device (16) for dispensing aerosol doses. This device (16) comprises—see FIG. 4—a counter (17) according to the invention which corresponds to the counter (2) and which is placed onto a storage container (18). The storage container (18) is connected moveably to the counter (17). When the device according to FIG. 4 is used, an actuating means in the form of the container (18) has to be pressed into the housing of the counter, as a result of which a mechanism situated in the storage container is actuated and is used to dispense an aerosol dose from the storage container (18). In the assembled state, the aerosol container (18) is connected to a spray nozzle (19) via the spray sleeve (70). The spray sleeve (70) is guided through the counter. The aerosol emerges from the spray nozzle (19). The spray nozzle (19) is connected immovably to the base plate of the counter (17).

The counting device (17) functions in precisely the same manner as the counting device (2). However, the counting device (17) shown in FIG. 3 is a remaining quantity counter which indicates how many aerosol doses can still be dispensed from the storage container (18). This is important for a user who requires the aerosol for medical reasons to know so that he can ensure that the storage container (18) is replaced in good time. In FIG. 3, the number "131" can be seen in the window (5), i.e. the storage container can still dispense 131 portions. If the starting point is, for example, a total number of 300 portions which can be dispensed from the storage container, the second counting ring bears the sequence of numbers "30, 29, 28, . . . , 02, 01, 00" and the first counting ring bears the sequence of numbers "0, 1, 2, . . . , 8, 9". This sequence of numbers can be provided a number of times on the circumference of the first counting ring.

Since the operation of the counter (17) corresponds to the operation of the counter (2) and both counters essentially comprise elements of identical design, the elements of the counter (2) will be described below. If there are differences from the embodiment of the counter (17), these will be explicitly specified.

The central element of the counter (2) is the guide element (11). The guide element (11) is of annular and hollow-cylindrical design. It has, on its inside, guide sections (20) against which the switching element shown in FIG. 6 bears with its outer side (21) and is guided. The clearances (22) provided on the guide element (11) serve as air-replenishing ducts in the event of the counter being used in an aerosol container.

The wall (23) of the guide element (11) contains two mutually opposite recesses (24), one edge (25) of the recess being designed as a curved surface (26) which, when a dose is dispensed, unavoidably guides the moving switching element (12) with respect to the fixed guide element (11). On the switching element (12) there are two outwardly directed projections (27) which pass through the recesses (26) from the inside to the outside. If the switching element (12) is displaced axially by means of pressure being exerted on the push button (4), then the projections (27) slide along the curved surfaces (26). The curved surface (26) has a total of three differentiable sections (26*a*), (26*b*) and (26*c*). In the section (26*a*), which runs in principle parallel to the longitudinal axis of the counter, the switching element (12) executes a purely axial movement as it moves. If the projections (27) run in the sections (26*b*) of the curved surfaces, as the axial displacement of the switching element (12) continues a rotation of the switching element (12) about its longitudinal axis is initiated at the same time. This rotation based on the stroke of the switching element (12) depends on the shape of the curved surface and can be set virtually as desired. In section (26*c*) the rotational movement is very largely at an end, the section (26*c*) permitting essentially only an axial movement of the switching element, which absorbs the remaining stroke.

During the axial movement of the switching element (12) in the region (26*a*), the switching cams (28) integrally formed on the projections (27) are introduced into a respective cam retainer (30) on the first counting ring (9). The cam retainer is designed as an internal toothing (29). This coupling of the switching element (12) to the counting ring (9) enables the rotational movement of the switching element to be transmitted to the counting ring (9). The end edges of the individual teeth of the toothing (29) are provided with oblique surfaces (31). When being introduced the switching cam (28) first of all strikes against an oblique surface (31), in which case the counting ring (9) starts rotating slightly; then the rotational movement which is controlled by the curved surface starts. At the end of the rotational movement, i.e. when the push button (4) has been substantially pushed through and the tablet has been dispensed, the counting ring (9) is rotated on by an angular increment, and the number following next is visible in the window.

The switching element (12) is moved counter to the force of the helical spring (13). The helical spring (13)—see FIG. 7—has a retaining pin (32) at each end. A retaining pin is fastened in a pin retainer (33) on the switching element (12) and the other pin (32) is secured in a pin retainer (34) of the base plate (14). The base plate (14) itself is fixed. When the switching element (12) is moved, the helical spring (13) is compressed and, from the beginning of the curve-controlled rotational movement, is additionally twisted; as a result, restoring forces acting in two directions are produced. If, after the end of the dispensing of the dose, the push button (4) is relieved of load, the helical spring (13) relaxes. The relaxation which arises owing to the axial compression displaces the switching element (12) in the axial direction, the relaxation caused by torsion simultaneously rotates the switching element through the curve-controlled rotational movement back into the starting position. The restoring movement is assisted by the curved surface (35) in the end wall of the recess (24).

There are guide surfaces (36) and (37) on the guide element (11). The first counting ring rests with its inner undercut surface (38) on the guide surface (36). The second counting ring rests with its guide surface (39) on the guide surface (37). The counting rings and the guide surfaces are designed or arranged in such a manner that the peripheral section (40) of the first counting ring (9), on the outer surface of which the inscription is provided, engages over the somewhat undercut section (41) of the second counting ring (10), so that the outer surfaces (42) of the first counting ring and (43) of the second counting ring, which outer surfaces are provided with the respective inscriptions, adjoin each other in an essentially flush manner. The second counting ring (10) is provided with a covering section (44) which serves to cover the inscription on the first counting ring (9) if, in the case of a remaining quantity counter, the entire dose quantity has been taken in its entirety.

The manner in which the first counting ring is rotated by an angular increment when the particular actuating means is actuated has been described above. However, it is furthermore required to rotate the second counting ring further, likewise by an angular increment, at certain times or after a certain number of dispensed portions.

The mechanism suitable for this purpose for coupling the first counting ring to the second counting ring comprises a latching pawl (45) which is provided on the first counting ring and can be moved in the manner of a spring arm. The latching pawl (45) has a first projection (46) and a latching lug (47). The first projection (46) extends in the direction of the base plate (14). In the example shown, there is a further projection (48) at a certain position on the base plate (14)—see FIG. 11. When the first counting ring (9) is in an appropriate rotational position, the projection (48) interacts with the projection (46) during the next-following rotation of the first counting ring. The projection (46) runs with its oblique surface (49) onto the further projection (48), in which case the latching pawl (45) is lifted up. During this lifting-up process the latching lug (47) reaches into the end toothing (50) of the second counting ring (10). The toothing (50) also has oblique surfaces (51). If the first counting ring (9) is rotated further, the second counting ring (10) is simultaneously also rotated further by an angular increment as a consequence of the movement coupling. As soon as the projection (46) has migrated over the projection (48) it moves behind it again back into its starting position, as a result of which the coupling between the two counting rings is released. Each further movement of the first counting ring does not entrain the second counting ring. There may be a plurality of projections (48) on the circumference of the base plate (14) if the second counting ring is to be entrained in a plurality of rotational positions of the first counting ring.

So that the counting rings (9) and (10) remain in their respective positions, there are pairs of detent pawls (52) and (53) in the manner of spring arms on the guide element (11). The two detent pawls (52) interact with the internal toothing (29) and the two detent pawls (53) interact with the end toothing (51). The pairs of detent pawls (52) and (53) engage via latching lugs (54) and (55) in the respective toothing and thus lock the respective counting ring in its position. In the case of both pairs of detent pawls (52) and (53), one detent pawl of the pair of detent pawls (52) engages temporally before the other detent pawl of the pair of detent pawls (52). The same is true for the pair of detent pawls (53). This enables an actuation of the actuating means which has led to the dispensing of a tablet or the like to be counted even if the stroke of the switching element has not yet completely finished, since the first leading detent pawl has engaged but the second detent pawl has not yet engaged. If the stroke is then ended and the actuating means is relieved of load, the counting is retained although just one detent pawl has engaged.

FIG. 5 furthermore shows a stop (55) on the guide element (11), against which a projection (55*a*) present on the second counting ring (10) strikes when the second counting ring has reached its end rotational position, and the number "00" on the second counting ring appears in the viewing window. This limitation of the end position of the second counting ring is required only in the case of a remaining quantity counter or total quantity counter. In the case of a daily quantity counter either the stop (55) or the projection (55*a*) is absent.

Furthermore, there is a plurality of latching elements (56) on the guide element (11), by means of which the guide element (11) latches on the base plate (14); the base plate has a corresponding edge shoulder (58) which bounds the annular space (57). The latching forms a unit of guide element and base plate which can be released only with difficulty.

Further latching elements (59) which latch behind the shoulder (61) are provided on the opposite side of the guide element (11). The shoulder (61) bounds the annular opening (60) of the second counting ring (10). The latching of the guide element (11) on the base plate and on the second counting ring (10) results in a unit which can be pre-assembled, can be difficult to release and comprises the elements of second counting ring, guide element, switching element, spring, first counting ring, base plate.

As FIGS. 8 and 9 show, the first counting ring (9) has an external toothing (62) which encircles it through approximately 270 degrees. The second counting ring (10) has—see FIG. 10—a further toothing (63) on the end edge which lies opposite the end edge having the end toothing (50). The toothings (62) and (63) can be used to set the starting position of the respective counting ring, which is required in particular in the case of daily quantity counters. At the start of doses being taken, the particular day is to be set on the second counting ring and, if appropriate, the number "1" is to be set on the first counting ring.

FIGS. 12 and 13 show the housing (6) in detail. This housing (6), which—see FIGS. 1 and 3—virtually completely encapsulates the counter, has, in addition to the window recess (5), further apertures (64) through which—see FIGS. 1 and 3—the toothings (62) and (63) can be reached and grasped by means of a tool. This enables the counting rings to be set to the desired starting position.

On its one end edge, the housing (6) has a plurality of latching elements (65) by means of which the housing is latched on the base plate (14), the latching elements (65) engaging around the base plate. On the opposite end side there is an undercut shoulder (66) which provides the end support for the push button (4) by means of the shoulder (67) provided there. The overall result is thus a completely encapsulated counter, the elements of which are connected virtually unreleasably to one another. The counter can be placed in a simple manner onto a storage container—e.g. onto a tablet container.

When the counter is used with an aerosol container, see FIGS. 14 and 15—there is a disk-shaped body (68) which has a retainer (69) for the spray sleeve (70) of the aerosol container (18). The nozzle (71) from which the aerosol is ejected leads away laterally therefrom. The nozzle (71) protrudes into an edge recess (72) of the housing. The aerosol is ejected from the housing in the region of this edge recess (72).

All of the elements of the counter are preferably manufactured from plastic. The central elements are the guide element and the switching element which are preferably manufactured from a high-quality plastic, for example polyoxymethylene. The counter can be mounted in a simple manner, since it is of a simple plug-in system. Only the spring is preferably made from metal, but a plastic spring may also be used.

A magnifying glass may be provided in the window opening of the housing. This magnifying glass may be inserted as a separate element into the housing if the housing consists, for example, of an opaque plastic. The magnifying glass may be manufactured integrally with the housing if the housing consists of a transparent plastic, for example polymethyl-methycrylate.

The counter may also be used in connection with an angled component for an inhaler. In this case, the spray nozzle may be integrated in the angled component and it is possible for just the aerosol container together with the counter snapped onto the aerosol container to be inserted into the angled component.

The invention claimed is:

1. A counter for counting metered doses of liquid, pasty or solid products from a storage container, the counter comprising:

at least one counting ring arranged coaxially with a longitudinal axis of the counter and mounted rotatably, and provided with a switching device configured to rotate the counting ring when an actuator that can be moved essentially lineally and in a direction of the longitudinal axis of the counter is actuated, and, when the actuator is actuated, a dose of the product is dispensed from the storage container, the switching device comprising a guide element and a switching element both arranged coaxially with the longitudinal axis, the switching element configured to be moved axially and azimuthally with respect to the guide element, and wherein the switching element has a projection that, when the actuator is actuated, is guided along a curved surface provided on the guide element such that a switching cam provided on the switching element is brought into engagement with a cam retainer provided on the at least one counting ring and then a rotational movement is initiated causing the at least one counting ring to be rotated by an angular increment.

2. The counter for counting metered doses of liquid, pasty or solid products from a storage container as claimed in claim 1, comprising:

a first counting ring and a second counting ring arranged coaxially with the longitudinal axis of the counter and mounted rotatably relative to each other and configured to be coupled to each other, and provided with a coupling device for coupling the first counting ring to the second counting ring for moving both counting rings together.

3. The counter as claimed in claim 1, comprising:

a curved surface on an end edge of a recess in a wall of the guide element, the projection engaging in the recess.

4. The counter as claimed in claim 3, wherein the curved surface is shaped such that the switching element moves axially at a beginning of a stroke movement, then moves axially and azimuthally combined, and moves axially at an end of the stroke movement.

5. The counter as claimed in claim 1, wherein the guide element is essentially annular, and the switching element is essentially hollow cylindrical, and is arranged in an interior of the guide element.

6. The counter as claimed in claim 1, comprising:

two mutually opposite projections on the switching element, and two mutually opposite curved surfaces on the guide element.

7. The counter as claimed in claim 1, wherein the switching element is configured to be moved counter to a restoring force.

8. The counter as claimed in claim 7, further comprising:

a spring that produces the restoring force and that is tensioned during rotational movement and returns the switching element with simultaneous reversed rotation into a starting position as soon as the switching cam no longer engages in the cam retainer.

9. The counter as claimed in claim 8, wherein the spring is a helical spring mounted with a first end on a base plate and with a second end on the switching element.

10. The counter as claimed in claim 1, wherein the switching cam is integrally formed on the projection.

11. The counter as claimed in claim 1, wherein a toothing of the first counting ring interacts with the switching cam and has an oblique surface on a side facing the switching cam.

12. The counter as claimed in claim 1, wherein on the guide element there are one or more guide sections against which the switching element bears, there being at least one clearance in which the switching element is at a distance from the guide element.

13. The counter as claimed in claim 1, further comprising:

at least two detent pawls provided on the guide element, each detent pawl interacting with the toothing of the first and of the second counting ring and preventing the counting rings from rotating in a direction opposed to a counting direction.

14. The counter as claimed in claim 13, wherein the two detent pawls are offset with respect to each other and engage in the toothing at different angles of rotation during rotation of the counting ring.

15. The counter as claimed in claim 1, comprising:

guide surfaces for the first and the second counting ring, which surfaces are provided on the guide element, and at least first and second latching elements, of which the first engages behind a latching section of the second counting ring and the second engages behind a latching section of the base plate, the base plate guiding the first counting ring on a side lying opposite the guide element, with a result that the counting rings, the guide element, the switching element, the spring element, and the base plate form a manageable unit.

16. The counter as claimed in claim 15, wherein a coupling device comprises at least one first projection provided on the base plate and at least one latching pawl provided on the first counting ring and has a second projection, the first projection interacting with the second projection in an appropriate rotational position of the first counting ring such that the latching pawl is lifted up and engages in a toothing provided on the second counting ring.

17. The counter as claimed in claim 1, further comprising:

a stop provided on the guide element, against which a projection provided on the second counting ring strikes when the second counting ring reaches an end rotational position.

18. The counter as claimed in claim 17, further comprising:

a covering section on the second counting ring that, when the second counting ring moves into the end rotational position, is rotated into a viewing position, and which covers a region of the first counting ring.

19. The counter as claimed in claim 1, further comprising:

an essentially hollow cylindrical housing that has at least one window section through which markings provided on outer surfaces of the counting rings can be seen.

20. The counter as claimed in claim 19, further comprising:

an optical enlarging element provided in the window section.

21. The counter as claimed in claim 19, wherein at least two apertures are provided on the housing and are configured to be used for engagement in a respective toothing on the first or on the second counting ring for setting purposes.

22. The counter as claimed in claim 21, wherein in each case the two apertures are arranged at a distance from each other on a circumference of the housing and are assigned to each counting ring.

23. The counter as claimed in claim 19, further comprising:

latching elements configured to engage behind a latching section of a base plate on at least one end side of the housing.

24. The counter as claimed in claim 23, further comprising:

a shoulder that provides an end support for the actuator on an opposite end side of the housing.

25. The counter as claimed in claim 1, wherein the switching element bears directly against the actuator, which is configured to be displaced axially during actuation.

26. The counter as claimed in claim 1, wherein the actuator is configured as a push button that is an unremoveable part of the counter, or the actuator is configured as a storage container that can be coupled to the counter.

27. The counter as claimed in claim 1, further comprising a lid integrally formed on or fastened to a base plate and configured to cover the storage container, or a spray nozzle integrally formed on or fastened to a base plate.

28. The counter as claimed in claim 1, further comprising:

a securing mechanism configured to prevent an unintentional or unauthorized actuation of the actuator.

29. A device for the metered dispensing of the liquid, pasty or solid products, comprising:

a storage container that contains the product to be dispensed, and the counter as claimed in claim 1.

30. The device as claimed in claim 29, wherein the counter is configured to be placed releasably onto the storage container, or is integrated non-releasably on the storage container.

31. The device as claimed in claim 29, wherein the storage container is configured as an aerosol flask or as a cup-like container.

32. The device as claimed in claim 31, further comprising:

a mouthpiece into which the counter is integrated releasably or non-releasably, and into which the aerosol flask can be inserted releasably.

* * * * *

UNITED STATES PATENT AND TRADEMARK OFFICE

CERTIFICATE OF CORRECTION

PATENT NO. : 7,156,258 B2
APPLICATION NO. : 10/493067
DATED : January 2, 2007
INVENTOR(S) : Eckert It is certified that error appears in the above-identified patent and that said Letters Patent is hereby corrected as shown below:

On the title page, Item (54), and Column 1, the Title information is incorrect. Item (54) and Column 1 should read:

-- (54) COUNTER FOR COUNTING METERED DOSES OF LIQUID, PASTY OR SOLID PRODUCTS AND DEVICE FOR THE METERED DISPENSING OF SUCH PRODUCTS --

Signed and Sealed this

Thirteenth Day of March, 2007

JON W. DUDAS
*Director of the United States Patent and Trademark Office*